US006189609B1

(12) United States Patent
Shaaban et al.

(10) Patent No.: US 6,189,609 B1
(45) Date of Patent: Feb. 20, 2001

(54) GRIPPER BLOCK FOR MANIPULATING COIL TUBING IN A WELL

(75) Inventors: Khaled M. Shaaban; James A. Bodhaine; Alexander Sas-Jaworsky, II, all of Houston, TX (US)

(73) Assignee: Vita International, Inc., Houston, TX (US)

( * ) Notice: Under 35 U.S.C. 154(b), the term of this patent shall be extended for 0 days.

(21) Appl. No.: 09/159,811

(22) Filed: Sep. 23, 1998

(51) Int. Cl.[7] ..... E21B 19/08; E21B 19/22
(52) U.S. Cl. ..... 166/77.3; 166/384; 226/172
(58) Field of Search ..... 166/77.1, 77.2, 166/77.3, 384, 385; 198/626.1, 626.4; 74/144, 148, 162; 226/172

(56) References Cited

U.S. PATENT DOCUMENTS

| | | | | |
|---|---|---|---|---|
| 3,258,110 | * | 6/1966 | Pilcher | 198/626.4 |
| 3,559,905 | * | 2/1971 | Palynchuk | 166/77.3 |
| 3,754,474 | | 8/1973 | Palyachuk | 166/77.1 |
| 4,673,035 | | 6/1987 | Gipson | 74/162 |
| 5,094,340 | | 3/1992 | Avakor | 198/626.1 |
| 5,188,174 | | 2/1993 | Anderson | 166/77.3 |
| 5,309,990 | * | 5/1994 | Lance | 166/384 |
| 5,765,643 | * | 6/1998 | Shaaban et al. | 166/384 |
| 5,850,874 | * | 12/1998 | Burge et al. | 166/77.3 |
| 5,853,118 | * | 12/1998 | Avakov | 226/172 |
| 5,937,943 | * | 8/1999 | Butler | 166/77.2 |
| 5,975,203 | * | 11/1999 | Payne et al. | 166/77.3 |

* cited by examiner

*Primary Examiner*—George Suchfield
(74) *Attorney, Agent, or Firm*—Cynthia G. Seal

(57) ABSTRACT

A gripper block for use in an endless chain in a device for moving a generally cylindrical object longitudinally, as into or out of a well. The block has a first portion adapted to engage the endless chain and a second portion adapted to frictionally engage the object. At least a portion of the block is made from a resilient material that engages the tubing.

19 Claims, 4 Drawing Sheets

GRIPPER BLOCK FOR MANIPULATING COIL TUBING IN A WELL

FIELD OF THE INVENTION

The present invention relates to gripper units for use in injectors for coiled or reeled tubing, or similar elongate objects.

BACKGROUND OF THE INVENTION

Coiled tubing injectors like that shown in FIG. 1 were originally used during workover operations to inject a relatively small diameter, continuous length of coiled tubing into a well bore while the well was under pressure. Coil tubing has been used for many years in wells for performing certain downhole operations such as, washing out sand bridges, circulating treating fluids, setting downhole tools, cleaning the internal walls of well pipes, conducting producing fluids or lift gas, and a number of other similar remedial or production operations. In such a case, the tubing must be literally forced or "injected" into the well through a sliding seal to overcome the well pressure until the weight of the tubing exceeds the force produced by the pressure acting against the cross-sectional area of the tubing. Thereafter, the weight of the tubing has to be supported by the injector. The process is reversed as the tubing is removed from the well. In recent years, the coiled tubing has been used in combination with a mud turbine motor to drill original bores, has been used as the permanent tubing in production wells, and continues to be used in various workover and service applications. Because of the advantages of continuous coiled tubing, and the resulting new uses, the state of the art of manufacturing coiled tubing has rapidly progressed until tubing is almost three inches in diameter. These large tubings have a wall thickness and sufficient tinsel strength to support up to 20,000 feet hanging in a well bore.

The only method by which a continuous length of tubing can be either forced against pressure into the well, or supported while hanging in the well bore, while lowered or raised is by continuously gripping the tubing along its length. One way of achieving this is by utilizing a pair of opposed endless drive chains which are arranged in a common plane. Such drive chains are made up of links, rollers and gripper blocks. In some cases gripper inserts are used. These drive chains are generally driven by sprockets powered by a motor, such as a reversible hydraulic motor. The opposed drive chains grip the reeled tubing between them. These drive chains are backed up so that a number of pairs of opposed gripping blocks are in gripping engagement with the tubing at any given moment. As the chains are in motion and the tubing is being driven, each time a pair of gripper blocks is actuated to release their hold on the tubing another pair is actuated to gripping position. The moving drive chains are thus able to force the tubing into the well, or to remove the same therefrom depending upon the direction in which they are driven.

In order to handle progressively larger, longer, and heavier tubing, the gripping force must be progressively increased. This can be achieved by increasing the force pressing the gripper shoes against the tubing, by increasing the number of gripper shoes by increasing the length of the chains, by increasing the contact area of the gripper shoe, or by improving the gripping surfaces.

As the length of the chain increases, the tolerance problems to insure that all of the individual grippers are contacting the tubing with equal force presents a practical limitation, which has been overcome in current designs. The application of greater force to press the grippers against the tubing, however tends to deform the tubing. Current grippers are typically surfaced with carbide grit which can penetrate the surface of the tubing to the point of damaging the tubing. The use of carbide surface treatment is relatively extensive and the expensive chain must be replaced frequently because when the grit wears smooth, the grippers can no longer effectively handle the tubing. The grippers can encircle only a limited percentage of the circumference of the tubing because the grippers must engage and disengage from the tubing at the beginning and end of the active reaches of the chains, and any attempts to increase the circumferential contact has resulted in unacceptable marring of the surface of the tubing to the point of causing the tubing to fail. Any increase in the force applied to the gripper results in unsatisfactory deformation of the tubing, typically causing it to become permanently egg-shaped. All of these design variables have reached the practical limits using current designs for moderately sized tubing, and the larger tubing cannot be satisfactorily handled, except in relatively shorter lengths, with even larger and longer tubing presently being demonstrated.

The coil tubing has developed high performance, advanced composite tubing. One example of such composites is epoxy resins reinforced with fibers such as carbon or glass. Composite tubing is highly desirable because it possesses many characteristics that are superior to steel, such as, good corrosion resistance, high strength to weight ratios, low material density, good low cycle fatigue resistance and improved working pressures. However, existing coil tubing injectors are not designed to accommodate the outer surface of composite tubing and tend to mar and tear the tubing, reducing its useful life.

U.S. Pat. No. 3,754,474 issued to Alexander Palynchuk on Aug. 28, 1973 for "Gripper Pad". This patent discloses a gripper unit for use in an apparatus such as that disclosed in U.S. Pat. No. 3,559,905. This gripper unit includes "a gripper pad which includes a block having studs embedded therein. The block is made of a deformable elastomer material and studs are made of a metal softer than steel, preferably aluminum or aluminum alloy. With this design, the studs come into contact with the tubing to be injected. U.S. Pat. No. 3,754,474 is incorporated into this application by reference for all purposes.

U.S. Pat. No. 5,094,340 issued to Avakov on Mar. 10, 1992 for Gripper Blocks for Reeled Tubing Injectors discloses a gripper block having a V-shaped gripping surface that forms ridges. The gripping surface contacts the tubing at four locations spaced at 90 degrees around the tubing. U.S. Pat. No. 5,094,340 is incorporated into this application by reference for all purposes.

U. S. Pat. No. 5,188,174 issued to Anderson on Feb. 23, 1993 discloses a tubing injection apparatus with light-weight gripper blocks that are pressed against the tubing with varying hydraulic force. U.S. Pat. No. 5,188,174 is incorporated into this application by reference for all purposes.

None of the prior art teaches or suggests gripper blocks for reeled or coil tubing which will provide an adequate grip for tubing or similar objects of various sizes made from fragile composite materials currently in use and actively being developed for the coil tubing industry.

Grippers for reeled or coil tubing generally have been formed from steel and provided with notches having a radius slightly greater than that of the tubing. The steel grippers took a vise-like grip on the tubing and although they fit the tubing fairly closely, excessive squeeze often resulted in the tubing being distorted to an out-of-round condition and scarred.

Such gripper blocks are used extensively today, and since it is known that they can distort and scar the tubing it is desirable to provide improved grippers for reeled tubing which will overcome the shortcomings of the existing grippers. The present invention is an improvement over the gripping blocks used in the known prior art and overcomes many of the shortcomings associated therewith, and are more suitable for use in the modern oil industry where wells are deeper, conditions more severe, operations more costly, and damaged or ruined reeled tubing can cause considerable delays and added costs.

SUMMARY OF THE INVENTION

One embodiment of the present invention provides a gripper block for use in a coil tubing injector system. The injector has an endless chain for moving a generally cylindrical object longitudinally into or out of a well. The gripper block has a first portion adapted to engage the endless chain and a second portion adapted to frictionally engage the object, referred to herein as tubing. At least a portion of the second portion is made from a resilient material that engages the tubing.

Preferably, the resilient material is formed from a polymer. There are several types of polymers available however, materials such as polyurethane, nylon, polyamide or mixtures thereof are preferred. Polyamide, available from Timco, Inc. of Houston has shown good results. The entire gripper block or only the portion that contacts the tubing may be formed from this resilient, elastomeric polymer. The second portion of the gripper block preferably defines a groove sized to closely receive the tubing.

In a preferred embodiment, the first portion of the gripper block has a first end, a second end, and an attachment means. The attachment means includes a tongue means at the first end and having a hole extending transversely therethrough, and a pair of projections at the second end spaced apart to provide a slot for receiving the tongue of another like gripper block therebetween. The projections each having a hole extending therethrough alignable with the hole through the tongue for receiving a pin therethrough by which adjacent gripper blocks are connectable.

In another embodiment of the present invention, there is provided a gripper block for use in an endless chain in a device for moving a generally cylindrical object longitudinally, as into or out of a well. The gripper block has a first portion adapted to engage the endless chain, a second portion adapted to frictionally engage the object, and an insert removably engaged with the second portion, wherein the insert is made from a resilient material that engages the tubing. Preferably, the insert forms a first groove and the second portion of the gripper block forms a second groove which corresponds to and forms a keyway with the first groove in the insert.

A securing pin may be positioned in the keyway to prevent lateral and longitudinal movement of the insert within the second portion of the gripper block. The keyway preferably has a generally cylindrical shape however, any number of shapes are within the scope and spirit of this invention.

The insert has a bottom surface forming at least one elongated flange, and the second portion of the gripper block forms an elongated slot for receiving the elongated flange. Preferably the second portion of the block forms a cavity and two end walls for holding the insert in the cavity. The endwalls are preferably fixed to the insert to maintain the insert securely within.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention relates to a gripper block for use in existing coil tubing injector units. More particularly, the present invention relates to a gripper block having a portion thereof that contacts and grips tubing without damaging the tubing. The gripping portion of the block is made from a resilient material that is tubing friendly while being resistant to the harsh drilling conditions typically encountered in the field.

One aspect of the invention provides a gripper block that it is adapted for use in an endless chain in a device for moving a generally cylindrical object longitudinally, as into or out of a well. The gripper block is has a first portion that is adapted to be attached to the endless chain device and form a link thereof The block has a second portion that is adapted to frictionally grip the cylindrical object and move it along the axis of the device without damaging the tubing. The block can be made entirely out of a gripping material or an insert formed from the gripping material may be used. The generally cylindrical object as referred to herein includes but is not limited to a rod, pipe, coil tubing, or cable or other like object. The rod, pipe, coil tubing or cable may be made from composite materials that are typically vulnerable to marring or scratching from a steel gripper block.

Various materials can be used to make the gripping portion or insert of the gripper block described herein. It is preferred that the material be selected from polymers such as polyurethane, graphite composites containing polyalpha olefin intermediates or other polymers, polyamide or mixtures thereof It is preferred that the material used have a coefficient of friction of equal to or greater than 0.03, have high resistance to corrosion, have a compressive strength of about 14,000 pounds per square inch, a flexural strength of about 11,000 pounds per square inch, and a flexural modulus of 350,000 pounds per square inch. In addition, the preferred material for the gripping portion should be able to withstand temperatures encountered under normal operating conditions for a coil tubing injector, typically from between −40° and 340° C. Polyamide available from Timco, Inc. of Houston, Tex., has shown suitable results for the gripping portion of the gripper block.

The gripper block disclosed herein can be adapted to be used on various chain drive assemblies currently in use in the coil tubing industry. One example of such a device is shown in FIG. 1.

Figure 1:
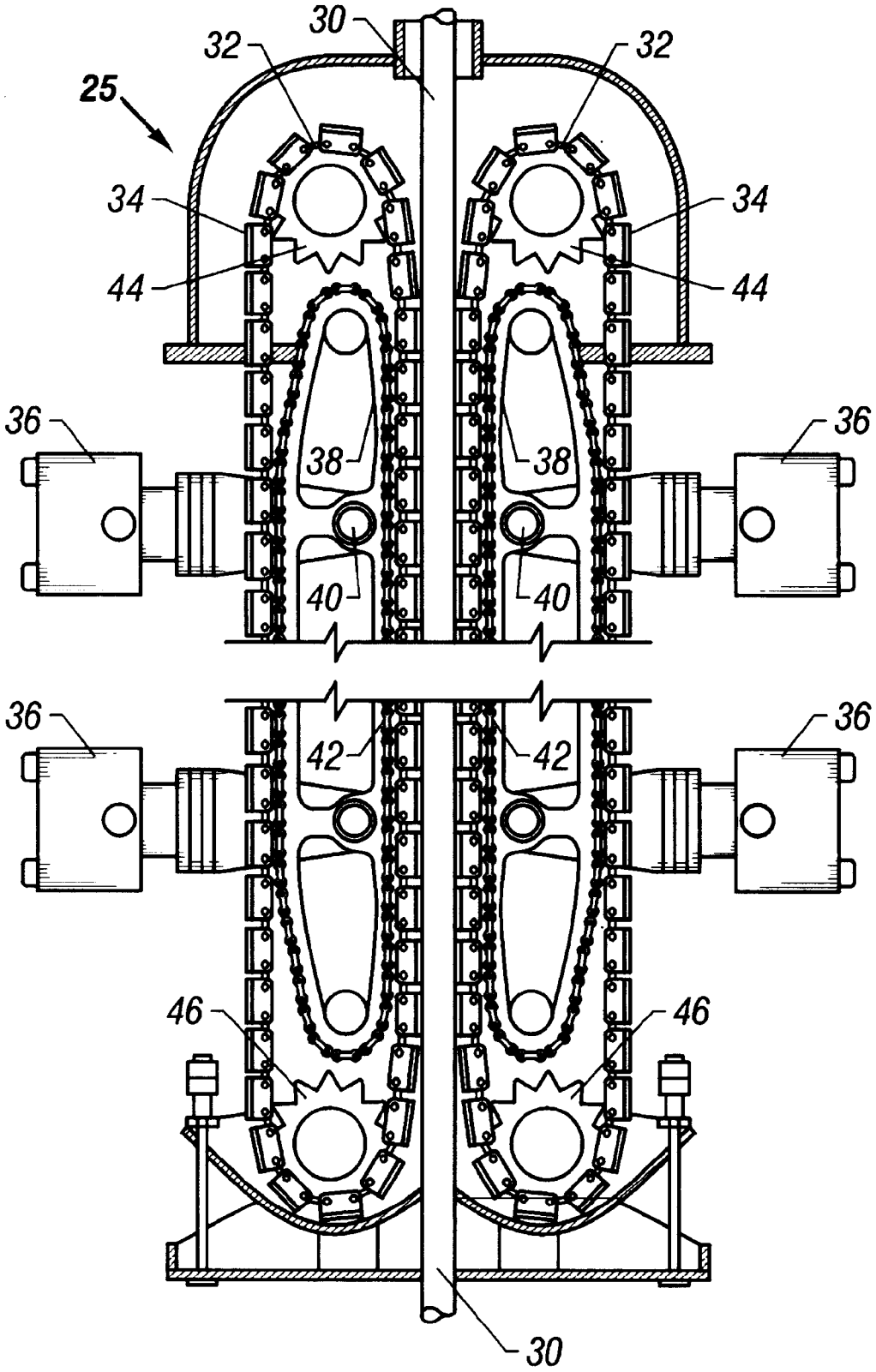
FIG. 1 is a schematic view of a reeled or coil tubing injector.

FIG. 1 is a schematic view of a reeled or coil tubing injector. The coil tubing injector is indicated generally by the reference numeral 25 and is shown gripping coil tubing 30. A pair of endless drive chains 32 each carrying a multiplicity of gripper blocks 34 are shown on opposite sides of the coil tubing 30. The gripper blocks are pressed against the coil tubing by hydraulic cylinders 36 biasing the pressure beams 38 inwardly through trunnions 40. A roller chain 42 is interposed between the pressure beams 38 and the drive chains 42 to reduce friction therebetween.

The drive chains 32 are actuated by sprockets 44 which can be powered by reversible hydraulic motors (not shown). Idler sprockets 46 take up slack in chains 32. Many pairs of opposed gripper blocks 34 along the pressure beams are in contact with and grip the coil tubing at any one moment during the time that the pressure beams 38 are pressed toward each other by the hydraulic cylinders 36. The squeeze thus applied to the coil tubing by the gripper blocks is varied by adjusting the hydraulic fluid pressure.

Figure 2:
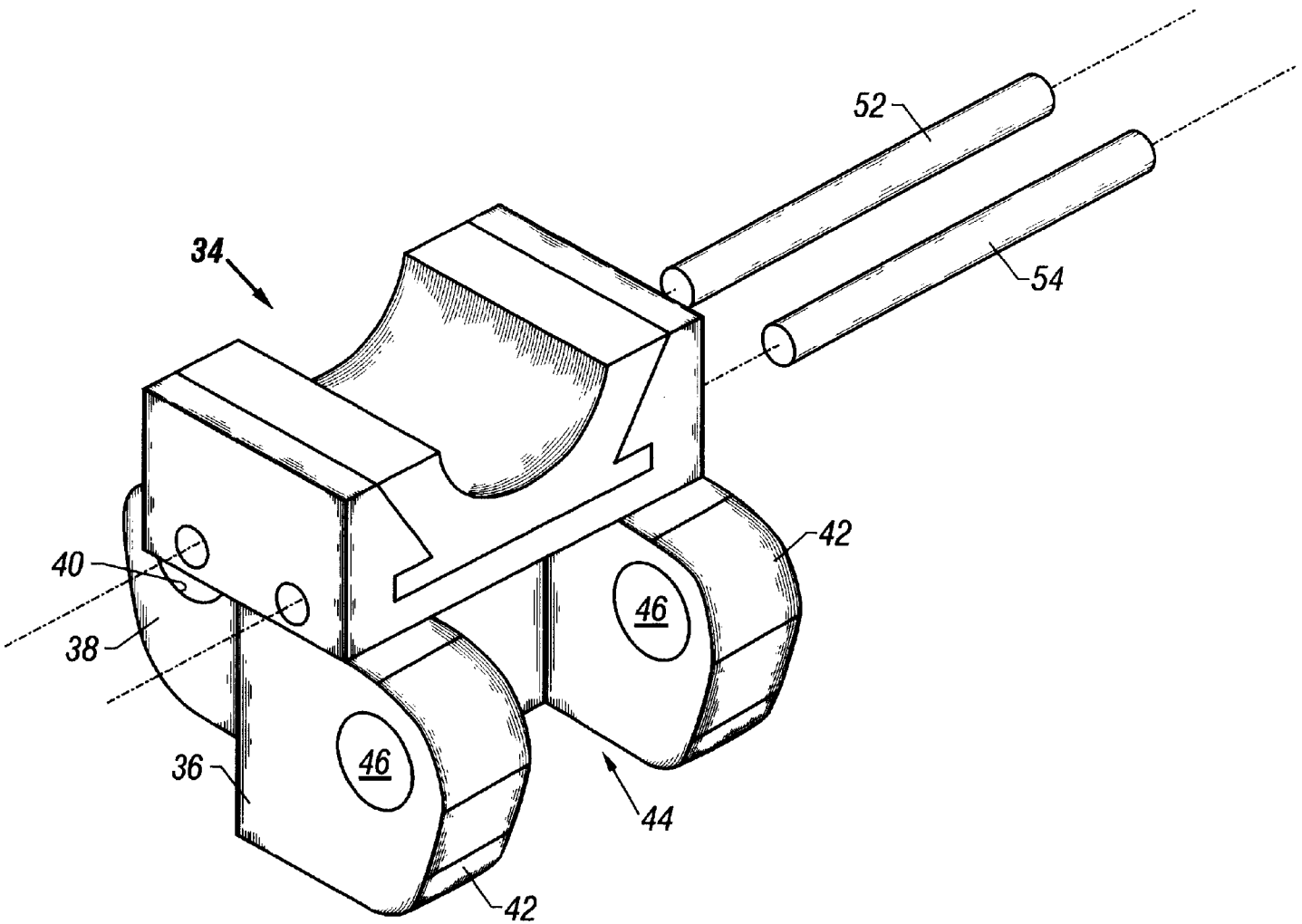
FIG. 2 is a schematic view of a gripper block of the present invention.
Figure 3:
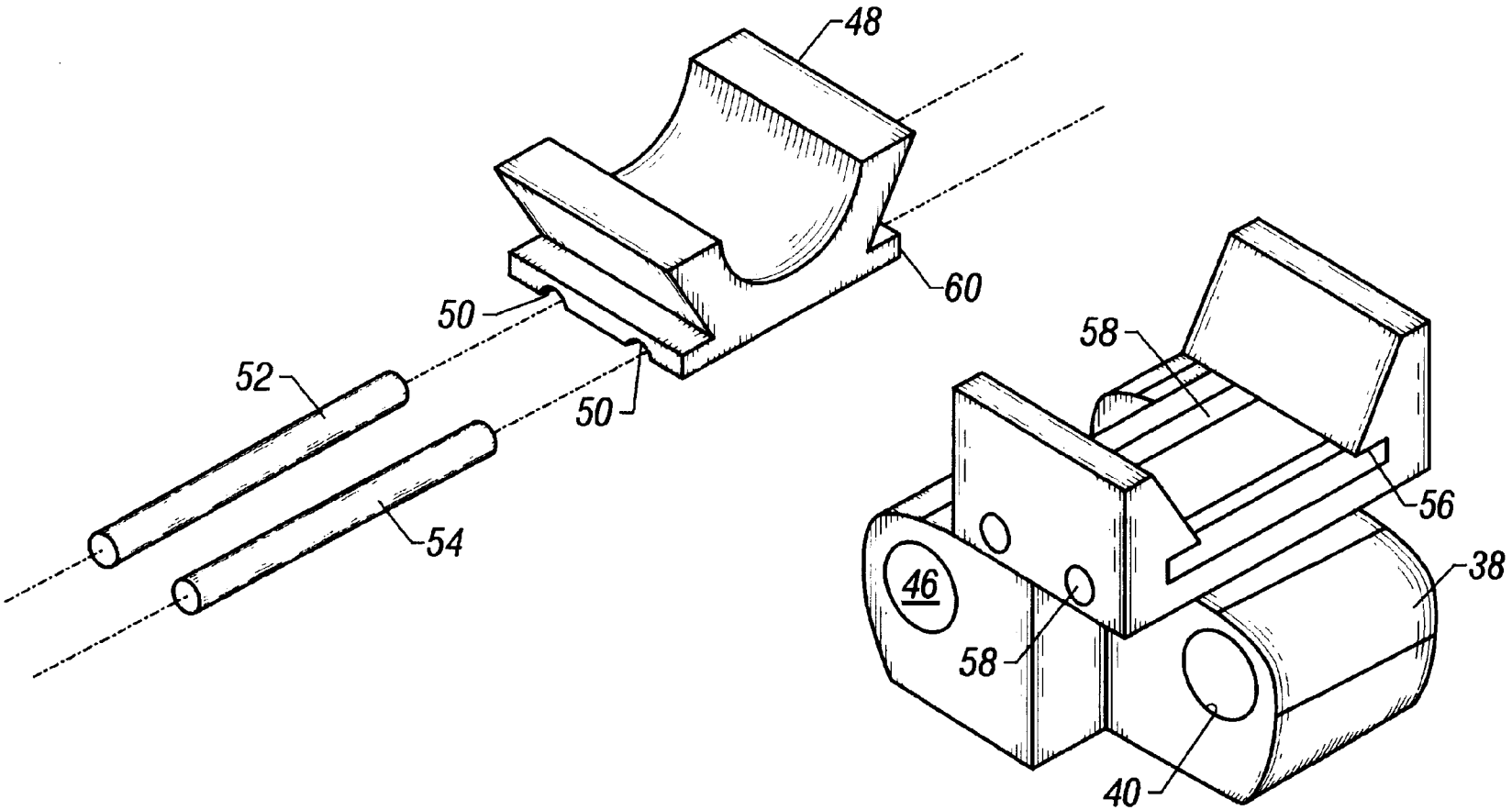
FIG. 3 is an exploded view of the gripper block shown in FIG. 2.
Figure 4:
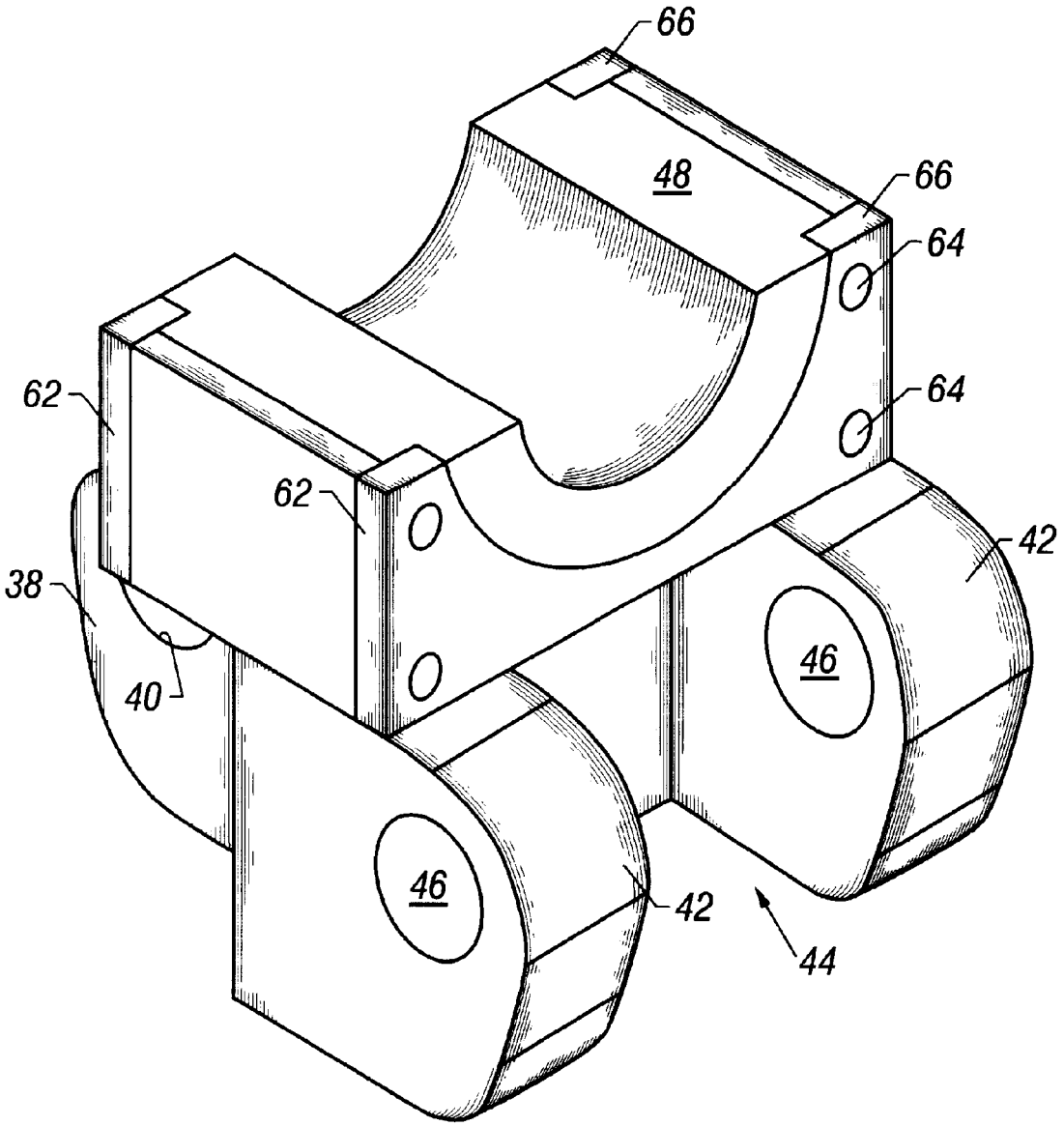
FIG. 4 is a schematic view of an alternative gripper block of the present invention.

A gripper block of the present invention is illustrated in FIGS. 2–4 where it is indicated generally by the reference numeral 34.

In FIG. 2, the gripper block 34 is provided with a body 36 having a first portion that is adapted to be received by an endless chain. The first portion includes a tongue 38 with a pin hole 40 extending transversely therethrough and a pair of spaced-apart ears 42 provide a slot 44 therebetween which is adapted to receive the tongue 38 of another adjacent gripper block. The ears 42 are each provided with a pin hole 46 and these holes are aligned. When two such gripper blocks are mated with the tongue 38 of one in position between the ears of the other, a pin can be placed in the aligned holes 40 and 44 to flexibly connect the two gripper blocks together so that they may articulate. Many such links are connectable together to form a chain such as that used in a coil tubing injector, for instance, such as that seen in FIG. 1.

FIG. 3 shows an exploded view of the gripper block 34 and an insert 48. The insert 48 forms a pair of grooves 50 that are sized to receive pins 52 and 54. The gripper block 34 has a second portion that is adapted to grip the tubing. The second portion includes an elongated slot 56 and a pair of grooves 58 for receiving the insert 48. The insert 48 forms a flange 60 that is sized to be closely received by the slot 56 and the grooves 50 line up with the grooves 58 to form a keyway. When the insert is positioned in the second portion of the gripper block 34, the pins 52 and 54 are then positioned in the keyway to secure the insert to the gripper block 34.

Although the gripper portion of the gripper block 34 is shown as being formed separately and then secured to the main body portion, the gripper block may also be formed in a single piece.

FIG. 4 shows an alternative way for securing the insert to the gripper block 34. The insert is held in place by a pair of end plates 62 that are secured to the insert with pins 64 or some other similar attachment means. The end plates have a portion 66 that extends over the top of the insert to restrict the horizontal movement of the insert as well.

It has been shown that the improved gripper block of this invention provides distinct advantages over the known prior art. It is understood that the foregoing description of the invention and the illustrative drawings which accompany the same are presented by way of explanation only and that changes in the shape of the gripper and arrangement of its elements may be had by those skilled in the art without departing from the true spirit of this invention.

We claim:

1. A gripper block for use in an endless chain in a device for moving a generally cylindrical object longitudinally, as into or out of a well, wherein the chain has a longitudinal axis, the gripper block comprising:

a first portion adapted to engage the endless chain; and a second portion adapted to frictionally engage the object, wherein at least a portion of the second portion is made from a resilient material that engages the generally cylindrical object and the second portion comprises a cavity defined by two sidewalls and two end walls adapted to hold the resilient material in the cavity.

2. The gripper block of claim 1, wherein the resilient material comprises a resilient polymer.

3. The gripper block of claim 1, wherein the resilient material comprises polyurethane, nylon, polyamide or mixtures thereof.

4. The gripper block of claim 3, wherein the material comprises polyamide.

5. The gripper block of claim 1, wherein the second portion defines a groove sized to closely receive the object.

6. The gripper block of claim 1, wherein the first portion has a first end, a second end, and an attachment means including:

a tongue means at the first end and having a hole extending transversely therethrough, and a pair of projections at the second end spaced apart to provide a slot for receiving the tongue of another like gripper block therebetween, the projections each having a hole extending therethrough alignable with the hole through the tongue for receiving a pin therethrough by which adjacent gripper blocks are connectable.

7. A gripper block for use in an endless chain in a device for moving a generally cylindrical object longitudinally, as into or out of a well, wherein the chain has a longitudinal axis, the gripper block comprising:

a first portion adapted to engage the endless chain;

a second portion adapted to frictionally engage the object; and an insert removably engaged with the second portion, wherein the insert is made from a resilient material defining a groove adapted to engage the generally cylindrical object.

8. The gripper block of claim 7, wherein the insert forms a first groove and the second portion of the gripper block forms a second groove which corresponds to and forms a keyway with the first groove in the insert.

9. The gripper block of claim 8, further comprising a securing pin positioned in the keyway to prevent lateral and longitudinal movement of the insert within the second portion of the gripper block.

10. The gripper block of claim 8, wherein the keyway has a generally cylindrical shape.

11. The insert of claim 7, wherein the insert has a bottom surface forming at least one elongated flange, and the second portion of the gripper block forms an elongated slot for receiving the elongated flange.

12. The gripper block of claim 7, wherein the second portion of the block comprises two end walls defining a cavity for holding the insert.

13. The gripper block of claim 12, wherein the endwalls are fixed to the insert.

14. A gripper block for use in an endless chain in a device for moving a generally cylindrical object longitudinally, as into or out of a well, wherein the chain has a longitudinal axis, the gripper block comprising:

a first portion adapted to engage the endless chain;

a second portion adapted to frictionally engage the object; and an insert removably engaged with the second portion, wherein the insert is made from a resilient material that engages the generally cylindrical object. wherein the insert forms a first groove and the second portion of the gripper block forms a second groove which corresponds to and forms a keyway with the first groove in the insert.

15. The gripper block of claim 14, further comprising a securing pin positioned in the keyway to prevent lateral and longitudinal movement of the insert within the second portion of the gripper block.

16. The gripper block of claim 14, wherein the keyway has a generally cylindrical shape.

17. The insert of claim 14, wherein the insert has a bottom surface forming at least one elongated flange, and the second portion of the gripper block forms an elongated slot for receiving the elongated flange.

18. The gripper block of claim 14, wherein the second portion of the block forms a cavity and two end walls for holding the insert in the cavity.

19. The gripper block of claim 18, wherein the endwalls are fixed to the insert.

* * * * *